United States Patent [19]

Blondé et al.

[11] 3,979,919

[45] Sept. 14, 1976

[54] TUNNEL FRAMING FOR POURED CONCRETE

[75] Inventors: Guy Blondé, La Frette sur Seine; Louis Lefebvre, St. Amand les Eaux, both of France

[73] Assignee: Societe Outinord-St-Amand, St. Amand les Eaux, France

[22] Filed: Dec. 30, 1974

[21] Appl. No.: 537,607

[30] Foreign Application Priority Data

| | | |
|---|---|---|
| Dec. 28, 1973 | France | 73.47219 |
| Jan. 30, 1974 | France | 74.03711 |
| Dec. 3, 1974 | France | 74.39448 |

[52] U.S. Cl. ..... 61/45 C; 61/63

[51] Int. Cl.[2] ..... E21D 15/14

[58] Field of Search ..... 61/42, 45 R, 45 C, 45 D, 61/63, 84; 248/354, 357

[56] References Cited

UNITED STATES PATENTS

| | | | |
|---|---|---|---|
| 1,226,444 | 5/1917 | Barber | 61/45 C |
| 2,749,713 | 6/1956 | Paurat | 61/45 C |
| 3,601,996 | 8/1971 | Levy | 61/45 C |
| 3,678,693 | 7/1971 | Markewitz et al. | 61/45 C |

*Primary Examiner*—Dennis L. Taylor

*Attorney, Agent, or Firm*—Robert B. Frailey

[57] ABSTRACT

The present invention relates to improvements in U-shaped tunnel shutterings or framing for poured concrete constituted by two half shells in the form of a right-angled dihedron, of which the edges of upper horizontal panels are connected by clamping locks and each of said edges is connected to the bottom of a vertical panel by braces of adjustable length, the reduction in length of the braces determining a reduction in the angle of the dihedron; said shutterings may be used either in the form of a complete "U" with the two half-shells connected, in which case lower parts of the two vertical panels are connected by removable horizontal bars of adjustable length, or as half-shells in which case props are used which are articulated on the free edge of the horizontal panel and rest on the ground.

15 Claims, 14 Drawing Figures

TUNNEL FRAMING FOR POURED CONCRETE

The present invention relates to improvements in U-shaped shutterings for poured concrete constituted by two half shells in the form of a right-angled dihedron, of which the edges of the horizontal panels are connected by clamping locks and each of said edges is connected to the bottom of a vertical panel by braces of adjustable length, the reduction in length of the braces determining a reduction in the angle of the dihedron; said shutterings may be used either in the form of a complete U with the two half-shells connected, in which case the lower parts of the two vertical panels are connected, at the level of the lower supports of the braces, by removable horizontal bars of adjustable length, or as half-shells, where the shuttering is stripped by the half-shells separately, in which case props are used which are articulated on the free edges of the horizontal panels and rest on the ground.

Such shutterings have already been described, particularly in British Patent No. 885,023 filed 13/6/1958. This Patent describes a process of casting cells and a shuttering composed of two half-shells which may be stripped separately. In practice, after having lowered and loaded the props on one side, one begins by removing the half-shells of the opposite side, then the freed part of the ceiling is shored and the second series of half-shell is then removable whilst the concrete has not yet completely set. The process and equipment mentioned hereinabove are advantageous when the concrete is slow to set.

On the other hand, at times when the concrete sets rapidly, in particular in summer, it may be more advantageous to strip the whole shells in one manoeuvre.

Two types of adaptation of shutterings must therefore be provided. In the first adaptation, (shuttering composed of separable half-shells), clamping locks have hitherto been provided which are constituted by an oscillating plate that may pivot on a vertical pin fixed to the edge of one of the horizontal panels and the other end of which has a slot which engages on a pin of the other horizontal panel. In this way, the two panels may be disconnected. In the second adaptation of shutterings (U-formed or complete shells), the horizontal panels are permanently integral by means of a clamping lock such as the one described in French Patent No. 2,136,400 of 11th Apr. 1972, filed by the present applicants. However, in all these shutterings, the spacing of the lower parts of the panels varies in the course of handling, which handling is fairly difficult. Furthermore, the manoeuvre are long and laborious.

In all cases, the braces are slightly shortened, this having for an effect slightly to reduce the right angle of the dihedron and to detach the horizontal panels from the ceiling, however, to this end, action should be rapid and energetic, in particular by the clamping locks being quickly released. This is not always possible and the lack of suppleness of the join between the horizontal and vertical panels is a hindrance.

Furthermore, the length of the braces is adjustable by screws, and adjustment must be made with accuracy when the shuttering is assembled. For stripping the shuttering, the length of the braces must be reduced, but these operations cannot be carried out at the same time and the shortening is sometimes poorly effected by inexperienced workers who turn the threads in the wrong direction or turn then too much so that there appears an unbalance of the stresses on the different braces of the same shuttering, certain braces even working in traction by transmitting their stress to a reduced number of braces which, in addition, support the weight of the concrete: this sometimes results in certain braces deteriorating by bending. Moreover, as explained in the preceding paragraph, the horizontal panels are detached more readily if the action is rapid and energetic. Now, the manoeuvring of the braces by screwing does not allow this action.

The present invention seeks to remedy these various drawbacks.

A first object of the present invention is to provide a shuttering which may be used in two different ways.

A second object of the present invention is to provide a device which avoids the deformation of the complete shuttering (in the form of a complete shell) during handling away from the construction.

A third object of the present invention is to provide means for rapidly and simultaneously acting on the clamping locks and the braces.

A fourth object of the present invention is to provide a better possibility of lowering the horizontal panels whilst the shuttering is being stripped.

The shuttering according to the present invention is mainly characterised by the following combination:

a. means allowing simultaneous, rapid and reversible actuation of the groups of connecting members of the shuttering elements, i.e. said shuttering elements may all take up their initial position strictly identical with respect to one another after each manoeuvre, rapidly and without adjustment, groups of members comprising:

- the members of the clamping locks ensuring that the free edges of the horizontal panels are brought flush with each other;
- the members of the clamping locks ensuring that the free edges of the horizontal panels are maintained at different evels;
- the members of the clamping locks ensuring the assembling and disconnection of the free edges of the horizontal panels, as desired;
- the members of the braces allowing a rapid and reversible shortening of said braces which, moreover, have a means for finely adjusting their length, b. means facilitating the reduction of the angle of the dihedron formed by the horizontal and vertical panels;

c. and means such as at least two horizontal bars removably fixed to the bottom of the vertical panels and also having two means for changing their lengths, vis:

a means for fine adjustment, and a means for sharp, reversible shortening.

More precisely, the clamping lock is constituted by two articulation units fixed to each of the two edges and having,

- facing the other half-shell, a means for dismountably articulating an angled link for connection to the other unit of the other half-shell, and,
- facing each of the vertical panels, a means for articulating a lever viz. a locking lever, i.e. for maintaining the free edges at the same level, and an unlocking lever i.e. for maintaining the free edges one below the other, said levers having a catch-locking fork corresponding to the angled link.

According to a preferred embodiment of the invention, the fork of the locking and unlocking lever is mounted on an adjustable plate enabling the positions of immobilisation of the clamping lock to be slightly modified.

To facilitate and accelerate the manoeuvre, the locking lever on the other hand, relative to the same shuttering, are rendered fast with each other so as to be actuated simultaneously for locking or unlocking.

Furthermore, the means of articulating articulation units are yokes with at least one removable pin for each angled link. The removable pins relative to a half-shell are connected to a rod sliding along the upper free edge of said half-shell, i.e. parallel to pins, so as to be able to engage and disengage simultaneously all the pins. To facilitate unlocking, the removable pins are conical.

Another important feature of the invention resides in the fact that the braces and horizontal bars comprise a means for finely adjusting their length, which means can only be actuated in exceptional circumstances and a means for rapidly changing their length constituted by their division into two frames articulated along an axis parallel to the axes of the end articulations, said frames being maintained in alignment by a locking and only being able to bend in one direction, in the manner of a knee-piece under the effect of a connecting cross-piece connecting the ends of the frames extending beyond the axis of articulation of the two frames.

In certain cases, the braces is composed of two frames, one of which is constituted by two parallel, slightly spaced apart sections, between which pivots the other frame, one of the frame ends comprising a screw adjustment functioning by rotation of the frame. Another advantageous mode of construction consists in providing U-sectioned frames, articulated on one another, one of the frames covering the other and extending beyond the end of the first frame and the common articulation to articulate on one of the panels.

Another mode of construction of the braces with horizontal bars consists in providing them in two telescopic parts connected by compasses, one leg of which has a manoeuvring lever which enables the legs to be aligned in stable equilibrium in the position of maximum extension of the brace or of the horizontal bar, a ring being provided to lock the lever against the brace and to prevent said lever from being applied against said brace.

As far as the connection is concerned between the horizontal panels and the vertical panels at the level of the edge of the dihedron, it is made by a supple joint enabling the angle of the dihedron to be slightly varied, particularly with the aid of the braces. This supple joint is constituted by the placing, end to end, of the two parts of the form face which are maintained flush by two series of guides welded to the face abutting on the braces, one series being integral with the vertical panel, the elastic connection between the two panels being effected by tie-beams which may be constituted by bolts having elastic washers of the Belleville type.

All these improvements go towards a considerable increase in the versatility of use, and especially towards the rapidity, safety, convenience and efficiency of the shuttering and stripping operations. The versatility of use is conferred by the possibility of stripping the shuttering either in half-shells or in the complete U-shape by a simple and rapid manoeuvre. The other qualities are acquired by all the other devices of the present invention which, once the shuttering has been adjusted suitably at the beginning, make it possible for it to be manoeuvred rapidly both at the moment of stripping of the shuttering and at the moment of installation of the form or shuttering which instantaneously takes its original precise adjustments again. It should also be pointed out that the combination of the device for rapidly shortening the braces with the supple connection of the horizontal and vertical panels at the level of the edges of the dihedral makes it possible to apply a quick and energetic traction on the horizontal panels, favouring their stripping.

The invention will be more readily understood on reading the following description with reference to the accompanying drawings, in which.

Figure 1:
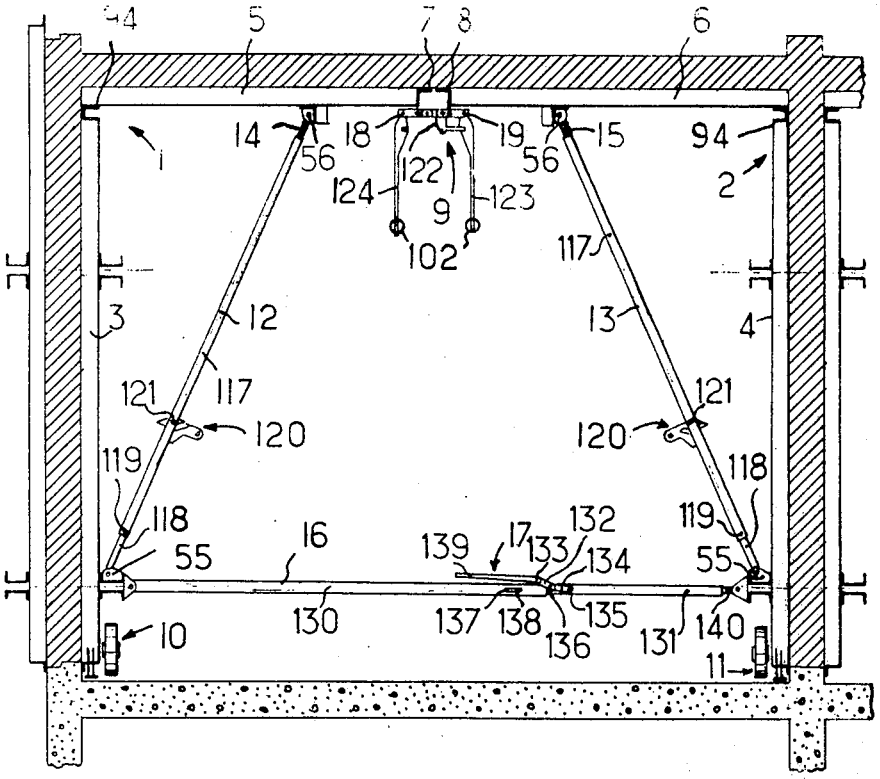
FIG. 1 is an elevation view of the whole of the shuttering with its two half-shells and which is disposed on concrete walls and a floor which have just been cast.
Figure 8:
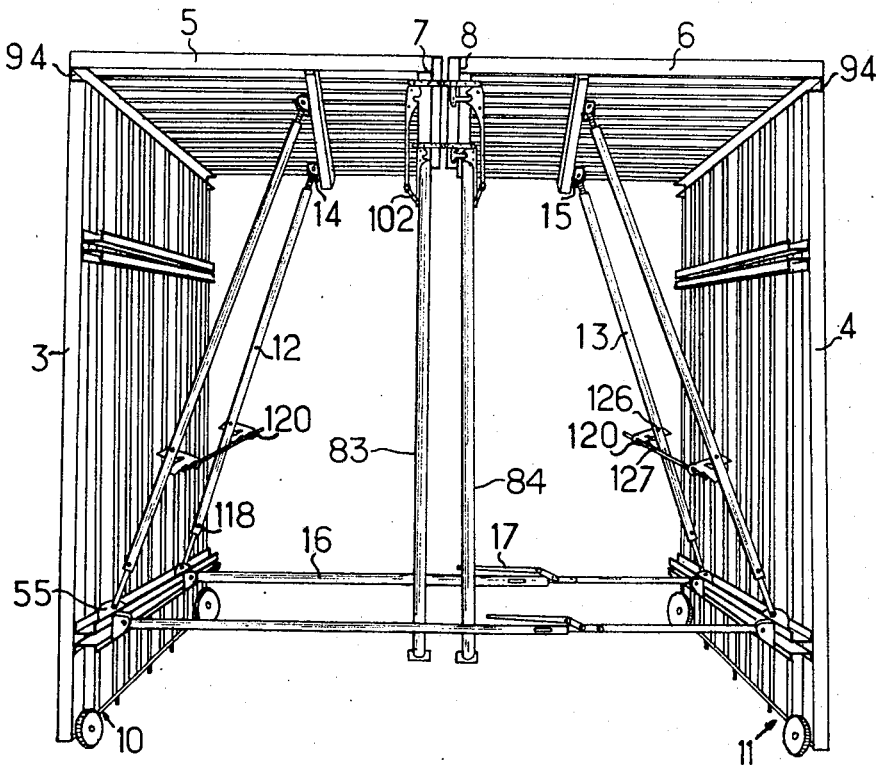
FIG. 8 is a perspective view of the whole of the shuttering with its two parts provided to be dismounted in half-shells with the aid of the props.
Figure 9:
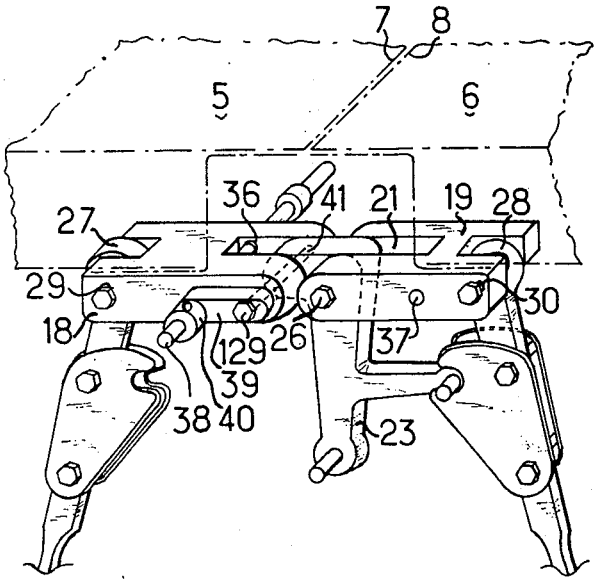
FIG. 9 is a perspective plan view of the joint of two horizontal panels of two half-shells in position ready for casting of the concrete.
Figure 10:
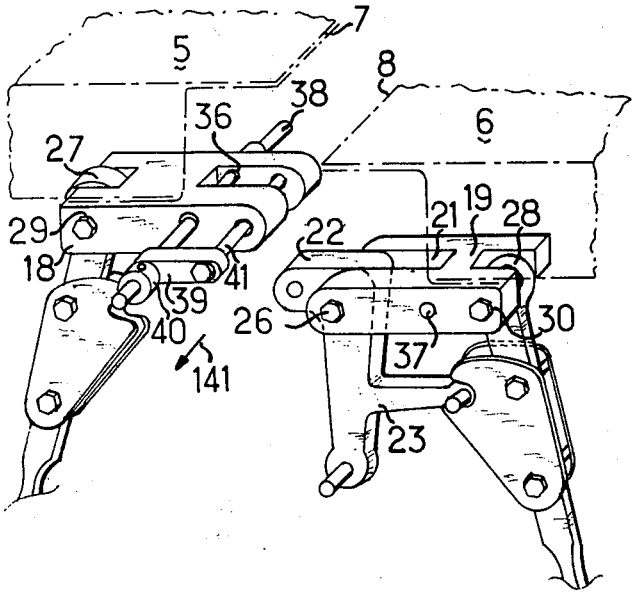
FIG. 10 is a view similar to that of FIG. 9 but in which the clamping lock has been released, not only to strip the shuttering but also to disconnect the two half-shells by simultaneously withdrawing the removable pins.
Figure 11:
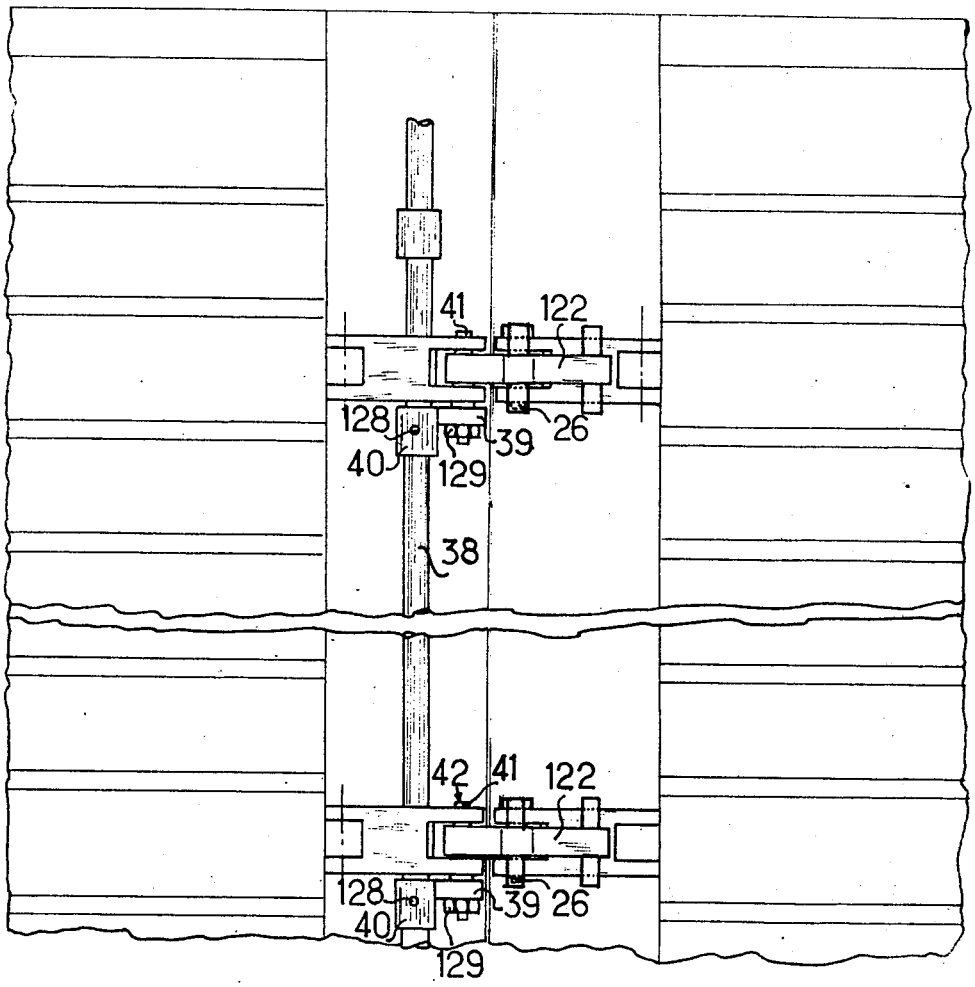
FIG. 11 is an inverted plan view of the joint of two horizontal shuttering panels with the device for simultaneously controlling the removable pins of yokes, the other elements of the clamping lock not having been shown for clarity of the drawing.
Figure 12:
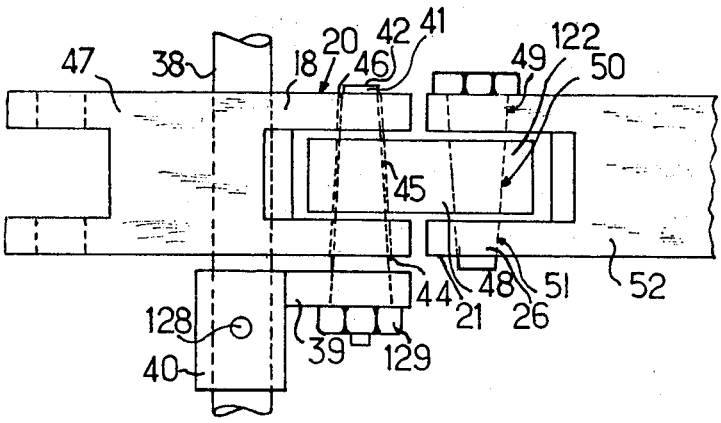
FIG. 12 is an enlarged inverted plan view in detail showing the device for locking and unlocking two horizontal parts of two half-shells as shown in FIG. 11.

Referring now to the drawings, and in particular to FIGS. 1 and 8, the shuttering is constituted by two half-shells 1 and 2 with vertical panels 3 and 4 and horizontal panels 5 and 6. Each half-shell constitutes a right-angled dihedron of which the edges 7 and 8 of the horizontal panels 5 and 6 are connected by clamping locks 9 which will be described in detail hereinbelow, with reference to FIGS. 2, 3, 9, 10, 11, and 12. The edges 7, 8 of the horizontal panels 5, 6 are connected to the bottoms 10, 11 of the vertical panels 3, 4 by braces 12, 13 whose length may be adjusted by a screwed fine adjustment devices 14, 15 in particular to which is added a locking device 120 allowing a sharp, reversible shortening of the braces. The lower parts of bottoms 10, 11 of the panels 3, 4, may be connected by horizontal bars 16 which have also a screwed fine adjustment device together with a device 17 for rapidly shortening the bar 16 similar to the device 120 for locking and shortening the braces 12, 13. The bars 16 are employed only in the case of the complete shuttering with the two half-shells 1, 2, being used (FIG. 1). For stripping the shuttering in two separate half-shells (FIG. 8), a bar 16 is not normally used, but props 83, 84 which support the free edges of the horizontal panels 5, 6 and rest on the ground to prevent the shuttering from falling at the moment when the clamping lock 9 is uncoupled. The use of props and shutterings is well known and was described in the Patents mentioned hereinabove. Of course, the shuttering may be adjusted in height by jacks disposed under the bottoms 10, 11 and they may be displaced longitudinally due to rollers disposed at the level of the bottoms 10, 11.

Figure 2:
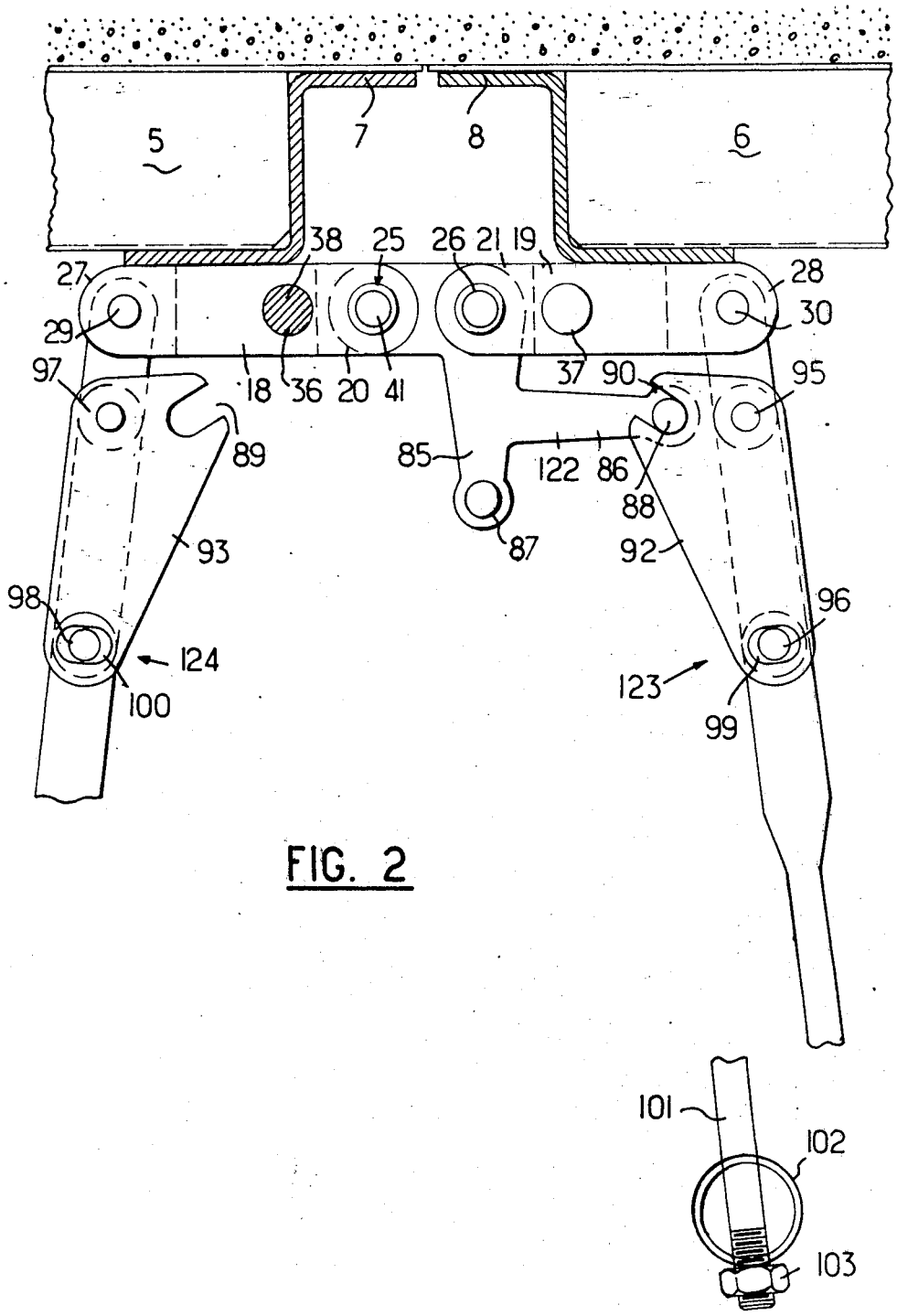
FIG. 2 is a detailed view of the clamping lock in locked position with the two horizontal panels of the shuttering flush with each other.
Figure 3:
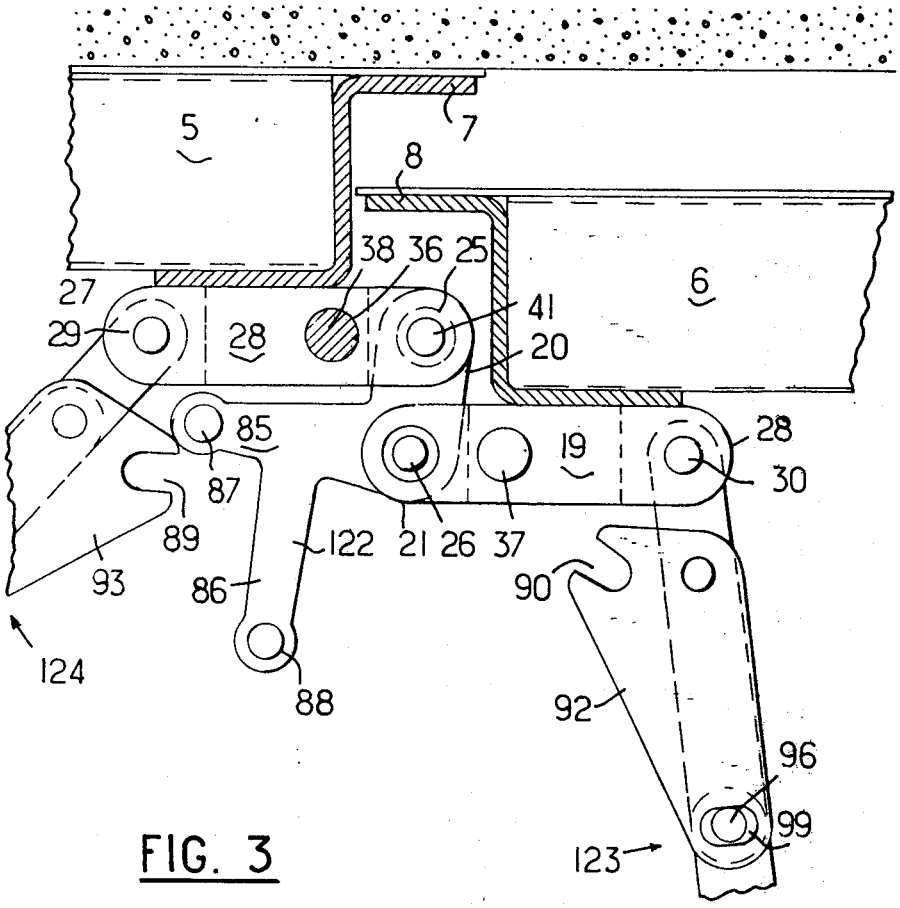
FIG. 3 is a detailed view of the clamping lock in unlocked position with one of the horizontal panels beneath the other.

With reference now to FIGS. 2 and 3, the lock 9 shown therein is constituted by two articulation units 18, 19 which are welded beneath the free edges 7 and 8 of the panels 5, 6. Each unit 18, 19 presents, facing the other corresponding half-shell, 2 and 1 respectively, a yoke 20, 21, in which the angled link 122 having two arms 85 and 86 is positioned, said arms being provided at their ends with catches 87 and 88. In addition, the articulation units 18 and 19 present, on the side opposite the yokes 20, 21, yokes 27 and 28 which receive levers 124 and 123 on which are screwed plates 92 and 93 having forks 89 and 90 intended to engage around catches 87 and 88. The plates 92 and 93 are fixed to lever 123 and 124, respectively, each one by screws 95, 96, and 97, 98. The screws 95 and 97 normally pass into a circular hole in the plates 92 and 93, whilst the screws 96 and 98 pass into oblong slots 99, 100, in the plates 92 and 93 before being screwed in a thread made in the levers 123, 124. This device makes it possible to vary the position of the forks 89 and 90 slightly and to ensure an adjustment, as will be explained later when the functioning is described. The link 122 is fixed in the yoke 21 by a pin 26.

As the units 18, 19 are strictly identical and disposed symmetrically beneath each of the free edges 7 and 8 and as the pins 25, 26, 29 and 30 may be removable, the position of the link 122 and levers 123, 124 may be reversed, although the inversion of these levers 123, 124 is not indispensable since they are identical.

The ends, such as 101, of levers 123, 124 relative to one and the same half-shell, are connected together by a bar 102, maintained by a nut 103. In this way, two or more levers 123, 124 may be manoeuvred simultaneously; this manoeuvre will be explained hereinafter in the section dealing with the functioning.

Referring now to FIGS. 9 to 12, in addition to FIGS. 2 and 3, it will be seen that the units 18 and 19 have, between holes 29 and 25, as well as 26 and 30, holes 36 and 37 whose axes are parallel to the axes of the other holes 29, 25, 26, 30. The holes 36 and 37 are intended to receive a rod 38 which runs along the whole length of one of the free edges 7 by sliding in said holes 36. Of course, the position could be reversed and the rod 38 could be placed in the holes 37 of the unit 19 relative to the other free edge 8. It may even be imagined that each of the free edges 7 and 8 is provided with a rod device 38, which will be described more completely hereinafter.

At the level of each unit 18, the rod 38 has a bayonet-shaped part 39 presenting a sleeve 40 in which the rod 38 fits and which is connected to said rod by a connecting pin 128. In this way, all the parts 39 located on the same rod 38 may simultaneously carry out the same movement controlled by the rod 38 which may be both displaced longitudinally and rotated about its axis. In addition, the part 39 presents a finger 41 fixed to said part 39 by a nut 129. The finger 41 may replace the pin 25 fixing the link 122 in the yoke 20. The end 42 of the finger 41 is conical so as to facilitate its introduction into corresponding holes of the yoke 20, and of the link 122. To this end, there have been provided for the conical finger 41 (FIG. 12) corresponding conical holes 44 and 46 in the unit 18 and a hole 45 in the link 122. Similarly, conical holes 49, 51 have been provided in the unit 19 and a conical hole 50 in the lever 122.

With the aid of the rod device 38 which actuates the bayonets 39, it is understood how two horizontal panels 5, 6 may easily be coupled or disconnected by simultaneously actuating all the fingers 41 which connect the links 122 to the units 18, 19.

Figure 5:
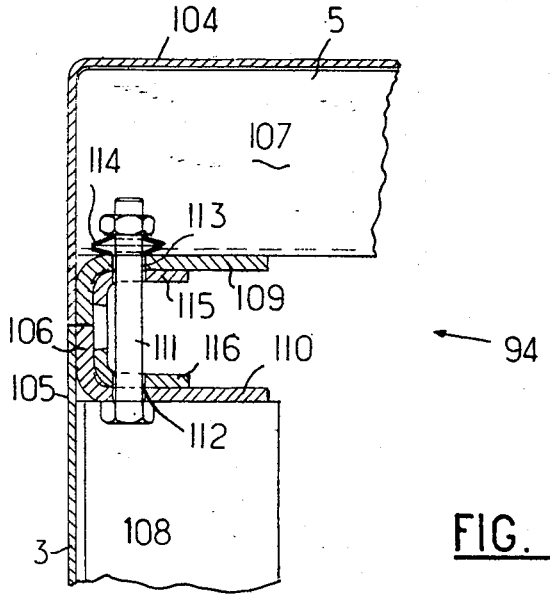
FIG. 5 is a vertical section through the articulated connection between the horizontal and vertical parts of a half-shell, along A—A of FIG. 6.
Figure 6:
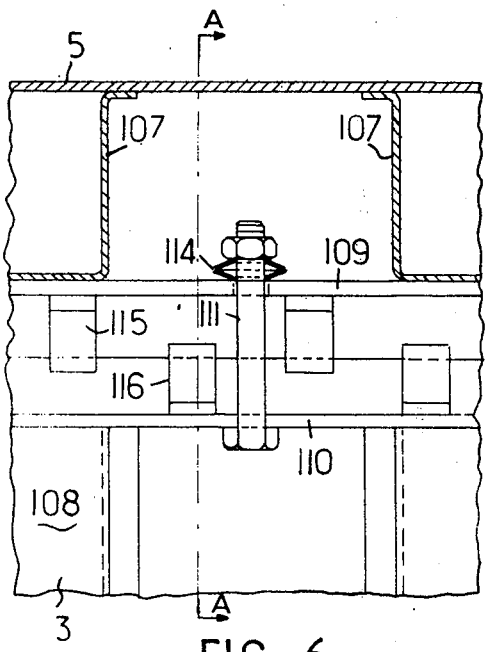
FIGS. 6 and 7 are side views respectively of the two versions of the supple joint, FIG. 6 corresponding to the version of FIG. 5.
Figure 7:
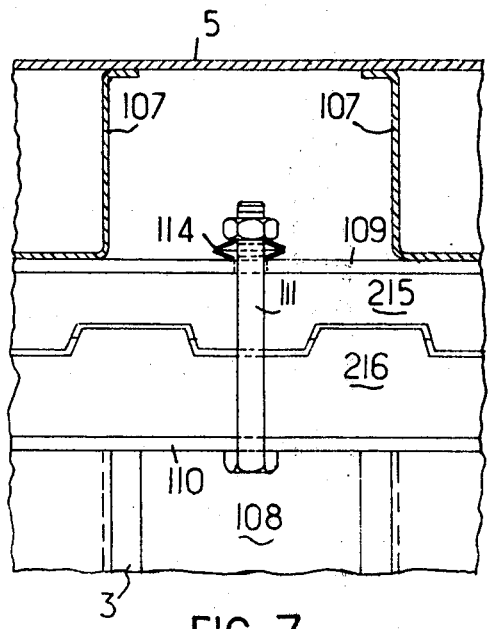

The connection 94 between horizontal panel 5 and vertical panel 3 is shown in detail in FIGS. 5 to 7. The form face 104 of the horizontal panel 5 is separated from the form face 105 of the vertical panel 3 by a joint 106 and the two form faces 104 and 105 are strictly flush with each other by means of two series of guides welded respectively to the panel 5 and face 104 as well as to panel 3 and face 105. The previous Patents filed by the present Applicants disclose that the panel 5 is rendered rigid by a series of omega-sections 107 whilst the panel 3 is rigidified by a series of omega-sections 108. An angled section 109 is welded to the omega sections 107 of panel 5 whilst another angled section 110 is welded to the omega sections 108 of the vertical panel 3. The two sections 109 and 110 reinforce the joint between the panels 3 and 5 which are connected at this level by the bolt 111 passing into the holes 112 and 113, respectively of sections 110 and 109. The elastic tightening of the bolt 111 is ensured by a pair of spring or Belleville type washers 114. The alignment of the two form faces 104 and 105 with respect to the joint 106 is ensured by two series of welded guides 115 and 116 on the face of the sections 109 and 110 oriented towards the braces 12. The guides 115 and 116 are in the form of small bars engaging on a part of the free height located between the horizontal parts of the sections 109 and 110. In other words, the guide 115 is applied both to the horizontal and vertical parts of the section 109. In this way, any relative horizontal movement between the panel 3 and the panel 5 is prevented. The same result is obtained (FIG. 7) by replacing the welded guides 115 and 116 (FIG. 6) by toothed elements 215 and 216, in the form of a rack, the teeth of which engage in one another.

Figure 4:
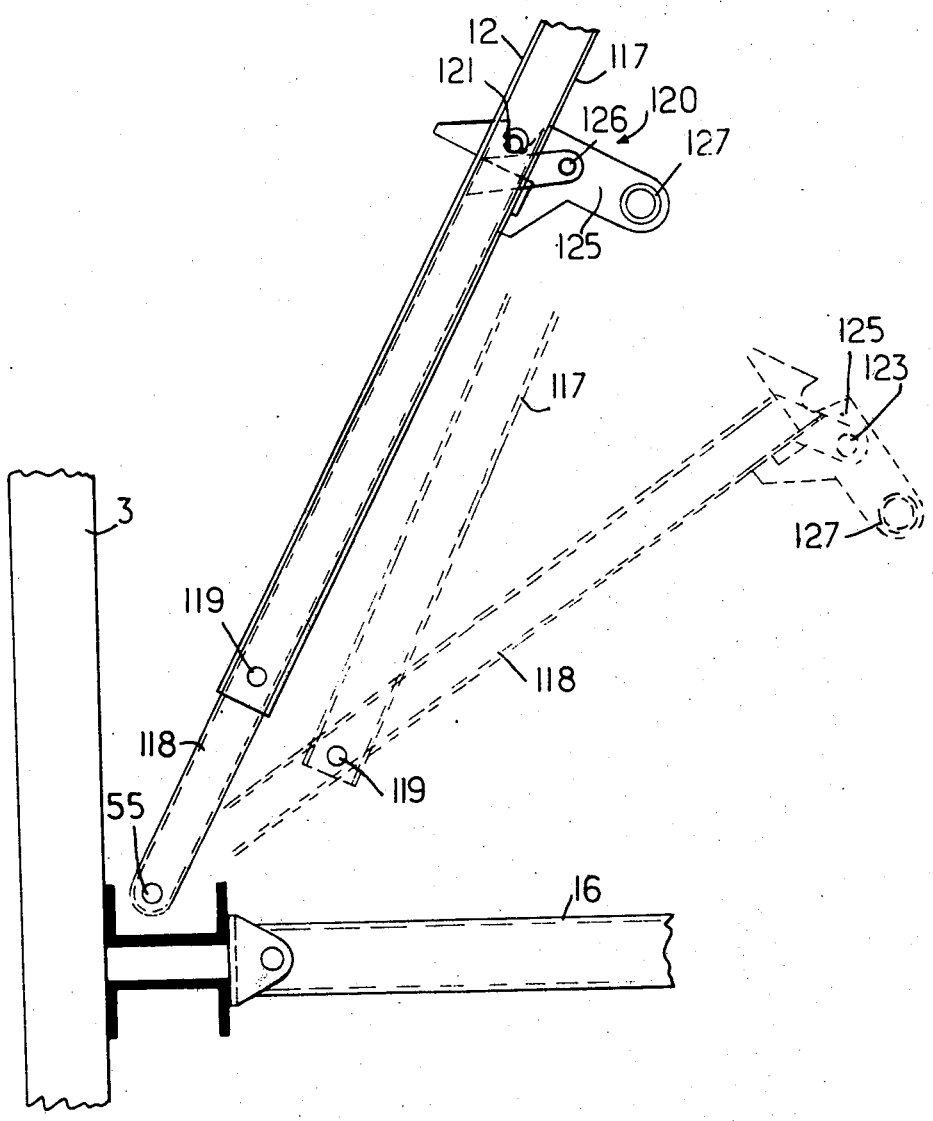
FIG. 4 is an elevational view of the lower part of a brace showing its constitution of two frames, said view showing in solid lines the locked brace (maximum length) and in broken lines the same brace but unlocked (shortening of the brace)
Figure 13:
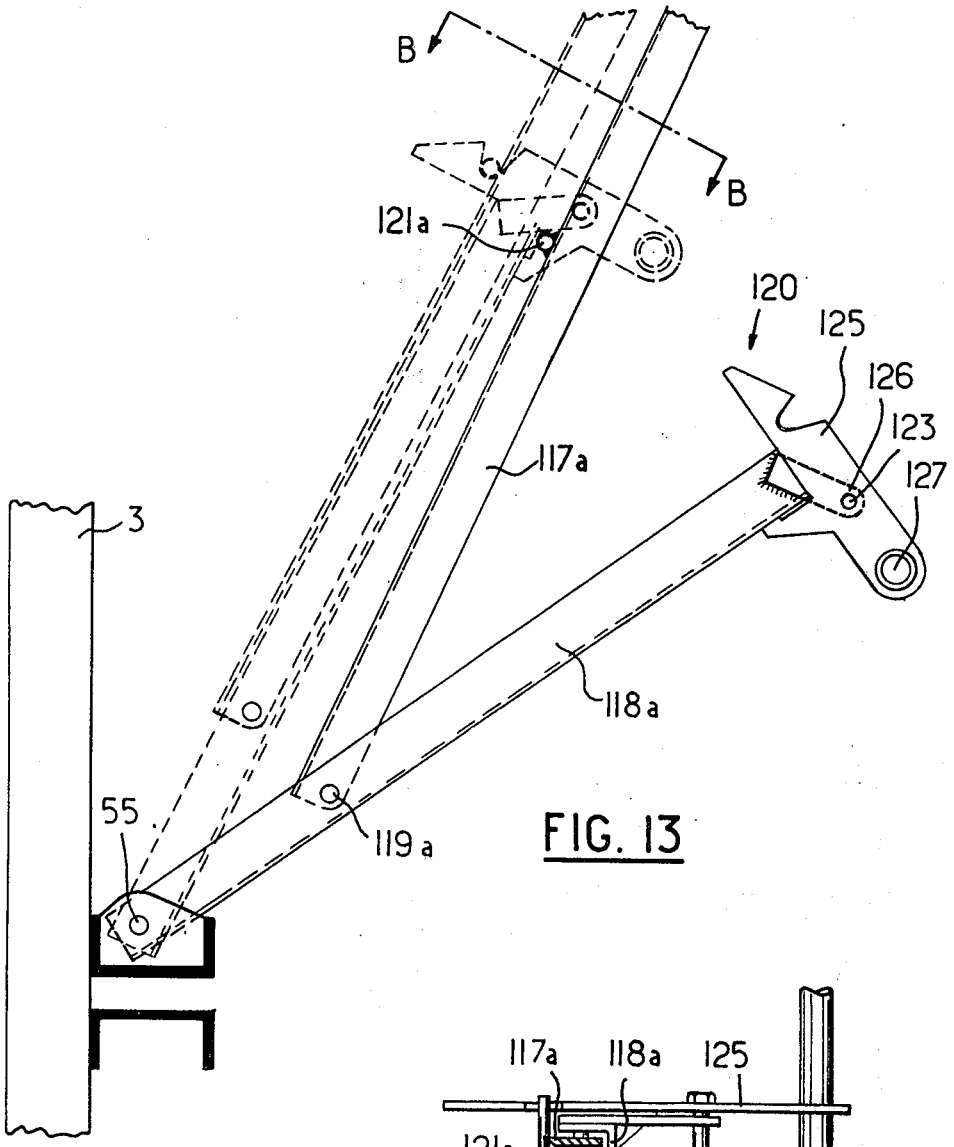
FIG. 13 is a view similar to FIG. 4 showing a variant of the brace with two U-sectioned frames, the solid lines corresponding to the unlocking whilst the simplified broken lines correspond to the locking of the brace in maximum extension.
Figure 14:
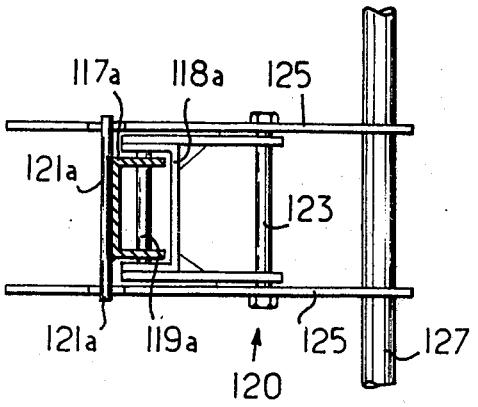
FIG. 14 is a section along B.B. of FIG. 13 with the two frames locked.

The braces 12, 13 (FIGS. 1, 4, 13, and 14) are divided into two frames 117, 118 articulated along an axis 119 parallel to the spaced axes of the end articulations 55, 56 of the braces 12, 13 disposed at the bottom of a vertical panels 3 and 4 and adjacent the horizontal panels 5 and 6. The two frames 117, 118 may be maintained in alignment by a locking device 120 shown in greater detail in FIGS. 4, 13, and 14.

According to a particular feature of the invention, the frame 117 is constituted by two parallel sections slightly spaced from each other, between which the frame 118 may pivot. The two sections constituting the frame 117 are maintained in spaced apart relationship by a fixed pin 121 on which a latch 125 pivotal about an axis 126 may engage. All the latches 125 of all the braces 12 or 13 relative to the same half-shell are connected by a bar 127 enabling them to be manoeuvred at the same time.

Other solutions could be applied to arrive at the same result as far as the shortening of the braces 12 or 13 is concerned, without departing from the scope of the invention. Moreover, the same device may serve to shorten the horizontal bar 16. For said latter, a solution has been adopted which could equally well be adopted for braces 12 or 13 and which will now be described.

The bar 16 is divided into two telescopic parts 130, 131 (FIG. 1) which are rendered integral by the locking device 17 in the form of compasses having leg 132, articulated on the part 130 at 133 and a leg 134 articulated on part 131 at 135. The two legs 132 and 134 are articulated at 136. The telescopic part 131 which returns longitudinally inside the telescopic part 130 has its stroke limited by a device constituted by a slot 137 pierced in the walls of the part 130, in which slides a catch 138 integral with part 131. The leg 132 of the device 17 is extended beyond the axis 133 by a manoeuvring lever 139. FIG. 1 shows the device 17 in maximum extension, i.e. the legs 132 and 134 are practically in alignment. To shorten the bar 16, the lever 139 must be lifted so that legs 132 and 134 form an angle together to bring axis 133 closer to axis 135 and consequently drive part 131 inside part 130. In position of maximum extension of the bar 16, the lever 139 is immobilised against the part 130 by any means, e.g. a ring or hook, which have not been shown. In addition, as for the braces 12, 13, the device 17 for rapidly modifying the length is completed by a fine screw adjustment 140.

The functioning of the device according to the invention will now be described.

Concerning the clamping lock 9, the angled link 122, connecting the units 18 and 19, may pivot according to the relative positions of the horizontal panels 5 and 6, which are determined by the action of the braces 12 and 13. When the panels 5 and 6 are at the same level, (FIG. 2), the angled link 122 is so arranged that the pins 25 and 26 are also at the same level, so that the arm 86 can be disposed horizontally in order that the catch 88 comes in the fork 90 of the plate 92 of the locking lever 123. The catch 88 engages automatically in the fork 90 and as the lever 123 is slightly inclined and is returned downwardly by its weight as well as by the weight of the bar 102, the locking is all the more sure as the two lateral walls of the fork 90 are practically directed towards axis 26. To perfect the initial adjustment of the alignment of the panels 5 and 6 at the beginning, the screws 95 and 96 may be slackened so as to cause the position of the plate 92 and the fork 90 move slightly until the two panels 5 and 6 are strictly at the same level; at this moment, the screws 95 and 96 are locked.

To unlock the clamping lock 9, it is sufficient to lift the bar 102 so as to raise the locking levers 123 relative to one and the same half-shell, this having for its effect to disengage forks 90, from the catches 88. This operation should be carried out at the same time as the shortening of the braces as will be explained hereinafter. When the catches 88 are released, the angled link 122 may pivot and take the position which is shown in FIG. 3. In the course of this manoeuvre, the catch 87 of the arm 85 may engage in the fork 89 relative to the plate 93 of the unlocking lever 124. When the shuttering is in stripped position, the panels 5 and 6 may be maintained at different levels by leaving the catches 87 locked in the forks 89. Unlocking is effected by simultaneously raising all the levers 124 by their bar 102 so as to allow the angled links 122 to be pivoted to a desired position, such as has been shown in FIG. 2.

As has just been indicated, the clamping lock 9 must be manoeuvred at the same time as the braces 12 and 13 which may be shortened or extended to a strict pre-determined value by causing the frame 118 to pivot with respect to the frame 117, by action on the bar 127. This latter makes it possible simultaneously to actuate all the latches 125 and to release them or engage them on pins 121. The weight of the bar 127 makes it possible to maintain the latches 125 on pins 121. It will be understood that when the frame 118 is folded back downwardly from the position where it is aligned with the frame 117, the whole of the brace shortens by a sufficient value to allow the horizontal panel 5 or 6 to lower by the value necessary for stripping provided that, at the same time, the clamping locks 9 are acted upon as indicated hereinabove.

The two preceding manoeuvres are facilitated by the presence of the connection 94 as described hereinabove and illustrated in FIGS. 5 to 7. The functioning of this joint is obvious. There is only juxtaposition between the elements of the panel 5 and panel 3 at the level of the joint 106. The panels 5 and 3 can therefore act freely with respect to each other. However, they are retained to one another by a bolt 111.

The functioning of the device for coupling and disconnecting the two half-shells 1 and 2 of the shuttering was partly explained in the description. It will now be completed with reference to FIGS. 9 to 12.

When the two half-shells 1 and 2 are coupled, the rod 38 is pushed so that all the bayonet shaped parts 39 are brought close to the units 18 for the fingers 41 to be driven into holes 44, 46, of said units 18 and in holes 45 of the angled links 122. The links 122 are furthermore articulated on the unit 19 by the pin 26, which is fixed. In this position, the shuttering may be used as a complete shell and the the clamping locks 9 function normally, as indicated hereinabove.

If it is desired to separate the half-shells 1, 2 from each other, it suffices to pull the rod 38 in the direction of arrow 141 (FIG. 10) to cause it to slide in holes 36 and separate the bayonets 39 from units 18; this has for its effect to withdraw the fingers 41 from holes 44, 46 and from unit 18 and also, and above all, from the holes 45 of the angled links 122. Said links 122 being released in this way, the two half-shells 1 and 2 may be separated.

Whilst the present invention has been described and explained with the aid of particular examples, explained hereinabove, it will be understood that it is not limited thereto. On the other hand, the following claims have for their purpose to define the invention generally, including there in all the different embodiments and modifications which would be obvious to the man skilled in the art.

What we claim is:

1. A tunnel-type shuttering comprising a pair of opposing detachable half-shells, each in the form of a right-angled dihedron, each half-shell including a swingable horizontal panel and a vertical panel, said two panels of each half-shell being pivotally connected to each other along a horizontal joint, said horizontal panels having elongated distal edges disposed in opposing relation when the shuttering is assembled, said shuttering further including:

a. a clamping lock having its components disposed adjacent the distal edges of the horizontal panels, said clamping lock being operative to ensure that the opposing edges of the horizontal panels are flush with each other, when the shuttering is assembled, b. axially adjustable braces connecting each horizontal panel to its vertical panel, c. said braces each comprising pivotally connected, complementally interengagable frames and a locking device for maintaining the frames of the braces in co-axial alignment when the shuttering is assembled, said locking device being operable to unlock the frames and permit their pivotal separation during disassembly of the shuttering, and d. axially adjustable horizontal bars removably fixed adjacent the bottoms of the vertical panels, said bars having means for modifying their length comprising 1. fine adjustment means and 2. a rapidly actuated, reversible shortening means.

2. Shuttering as claimed in claim 1, wherein the clamping lock includes a. at least one pair of spaced articulation units fixed adjacent the distal edges of the horizontal panels, b. an angled link disposed between each pair of articulation units and connected pivotally to each unit, c. catches disposed on the angled link, d. a locking lever engagable with the angled link for maintaining the opposing edges of the horizontal panels flush and e. an unlocking lever engagable with the angled link for maintaining the opposing edges of the horizontal panels vertically displaced relative to each other, f. each of said levers having a fork for engaging catches disposed on the angled link.

3. Shuttering as claimed in claim 2, wherein the forks of the locking and unlocking levers are mounted on adjustable plates enabling immobilized positions of the clamping lock to be slightly modified.

4. Shuttering as claimed in claim 2, having plural locking and unlocking levers, further including means for separately rendering the locking levers and the unlocking levers fast with each other, whereby each said groups of levers may be actuated simultaneously for locking and unlocking.

5. Shuttering as claimed in claim 2, wherein the articulation units are provided with yokes having at least one removable pin connected pivotally to an angled link.

6. Shuttering as claimed in claim 5, wherein the removable pins are connected to a slidable rod disposed parallel to the pins, whereby the pins are operative to engage and disengage the angled links simultaneously by axial movement of the slidable rod.

7. Shuttering as claimed in claim 6, wherein the removable pins are conically shaped.

8. Shuttering as claimed in claim 1, wherein each half-shell further includes means permitting a single half-shell to be used alone, said means comprising vertical props connected pivotally to the horizontal panel of the half-shell, proximate the distal edge of the panel, and extending vertically downward into engagement with a horizontal surface.

9. Shuttering as claimed in claim 1, wherein the braces and the horizontal bars comprise a means for finely adjusting their length, which can only be actuated in exceptional circumstances and a means for rapidly changing their length constituted by their division into two articulated frames along an axis parallel to the axes of the end articulations, said frames being able to be maintained in alignment by a locking and being able to bend only in one direction, in the manner of a knee-piece, under the effect of a connecting cross-piece connecting the ends of the frames extending beyond the axis of articulation of the two frames.

10. Shuttering as defined in claim 9, wherein the brace is composed of two frames, one of which is constituted by two parallel sections, in slightly spaced apart relationship, between which pivots the other frame, one of the frame ends comprising a screw adjustment functioning by rotation of said frame.

11. Shuttering as claimed in claim 9, wherein the brace is composed of two U-sectioned frames articulated on each other, one of the frames covering the other and extending beyond the end of the first frame and the common articulation, to articulate on one of the panels.

12. Shuttering as claimed in claim 1, wherein the braces and horizontal bars are in two telescopic parts connected by compasses of which one leg has a manoeuvring lever which enables the legs to be aligned in stable eliquibrium in the position of maximum extension of the brace, or of the horizontal bar, a ring being provided to lock the lever against the brace or bar.

13. Shuttering as claimed in claim 1, wherein the connection between the horizontal panels and the vertical panels at the level of the edge of the dihedron, is made by a supple joint enabling the angle of the dihedron to be slightly varied, particularly with the aid of the braces.

14. Shuttering as claimed in claim 13, wherein the supple joint is constituted by the placing, end to end, of the two parts of the form face which are maintained flush by two series of guides welded to the face abutting the braces, one series being integral with the vertical panels, the other series with the horizontal panel, the elastic connection between the two panels being effected by tie beams.

15. Shuttering as defined in claim 14, wherein the tie beams are bolts having elastic washers of the Belleville type.

* * * * *